US006391824B1

(12) United States Patent
Margarit Daroca

(10) Patent No.: US 6,391,824 B1
(45) Date of Patent: May 21, 2002

(54) PROCESS FOR THE PREPARATION OF COATED CONTINUOUS SHEETS TO BE PRINTED BY IMPACT-FREE HEAT PRINTERS, AND SHEET THUS OBTAINED

(75) Inventor: Pedro Margarit Daroca, Cabrils (ES)

(73) Assignee: Keylink Gestao E Investimentos LDA., Funchal (PT)

( * ) Notice: Subject to any disclaimer, the term of this patent is extended or adjusted under 35 U.S.C. 154(b) by 0 days.

(21) Appl. No.: 09/462,699

(22) PCT Filed: Jul. 8, 1998

(86) PCT No.: PCT/ES98/00197

§ 371 Date: Mar. 6, 2000

§ 102(e) Date: Mar. 6, 2000

(87) PCT Pub. No.: WO99/03687

PCT Pub. Date: Jan. 28, 1999

(51) Int. Cl.[7] ..... B41M 5/20

(52) U.S. Cl. ..... 503/218; 503/212; 503/220; 427/150

(58) Field of Search ..... 428/195, 488.4, 428/500, 522, 690; 427/331, 150; 503/212, 218, 220

(56) References Cited

U.S. PATENT DOCUMENTS

| | | | | | |
|---|---|---|---|---|---|
| 4,590,499 | A | | 5/1986 | Fujimura | |
| 4,627,997 | A | * | 12/1986 | Ide | 428/216 |
| 5,149,139 | A | | 9/1992 | Kaule | |
| 5,308,824 | A | | 5/1994 | Matsushita | |
| 5,420,094 | A | * | 5/1995 | Araki et al. | 503/216 |
| 6,031,021 | A | * | 2/2000 | Kenny et al. | 523/161 |

FOREIGN PATENT DOCUMENTS

| | | |
|---|---|---|
| EP | 0 748 698 | 12/1996 |
| GB | 1 494 103 | 12/1977 |

* cited by examiner

*Primary Examiner*—Bruce Hess
*Assistant Examiner*—Michael E. Grendzynski
(74) *Attorney, Agent, or Firm*—Sughrue Mion, PLLC

(57) ABSTRACT

A non-impact, thermal transfer printing sheet having a base sheet of fibrous paper or synthetic with or without a security device, coated with a composition comprising (1) lactone, spiropyrane coloration, or an iron metallic complexes that reacts with weak an organic acid to produce coloration when the sheet is heated via a thermal head, (2) an activator to accelerate the reaction, (3) absorbent materials to absorb the resulting products of the reaction, and (4) an inorganic phosphorescent ZnS:Cu pigment having a particle size sufficient to produce phosphorescence in a predetermined time and wave-length and a process of making thereof are disclosed. The sheet is capable of being printed using a thermal transfer printing head and providing phosphorescence when activated by ultraviolet light containing wavelengths of between 440 and 640 nm.

2 Claims, No Drawings

PROCESS FOR THE PREPARATION OF COATED CONTINUOUS SHEETS TO BE PRINTED BY IMPACT-FREE HEAT PRINTERS, AND SHEET THUS OBTAINED

The present invention relates to a procedure for the preparation of endless sheets coated with a prepared coating for printing using non-impact, thermal transfer printers, and which are also phosphorescent when activated by light containing wave lengths of between 440 and 640 nanometers, as well as to the sheet so constituted.

These sheets are designed for use in the manufacture of adhesive postage stamps and seals which must be obliterated (rubber-stamped) by automatic obliteration machines. The said sheets may then be bonded on their reverse side with damp-reacting adhesives or self-adhesive materials so that they can be applied after printing and punching onto the letters or objects to be sent, according to postal or other requirements, in a manner customary up until the present in the sending of correspondence and bulk franking.

CURRENT STATE OF THE ART

Currently, postage stamps are manufactured by two different methods:

1) Via thematic motif printing according to the series, together with the face value of the same.
2) Via printing of the thematic motif, on paper prepared for non-impact, thermal transfer printing which allows the possibility for the franking value to be post-printed using non-impact, thermal transfer printers at the moment of franking when the weight and destination of the correspondence to be franked is known.

On the other hand, in both cases, to invalidate the stamp once the letter or similar has been franked and to ensure in this manner that the stamp may not be used again for the same object, it is stamped with inks via a rubber stamp. This process receives the name of obliteration.

The obliteration process may be manual or automatic.

The manual obliteration process demands that an employee from the Post Office or similar entity manually stamps by rubber stamp all and each one of the stamps that have been affixed to the corresponding envelopes.

The automatic process necessitates automatic stamp detection, in such a manner that the stamp's position on the envelope is known in order to be able to obliterate or stamp it automatically. For this purpose there currently exist machines capable of fulfilling this function based on the stamp emitting phosphorescent light so that its exact position may be detected.

It has been demonstrated that non-impact thermal transfer printing greatly facilitates the franking of correspondence, and allows the use of self-adhesive stamps with a face value printed in the act of franking, this entire process fusing with the possibility of automatic obliteration with the object of invalidating the stamp once it has been used.

The technique of the invention claimed in this patent solves the problems of franking and the automatic obliteration of stamps and seals performed on sheets prepared for non-impact, thermal transfer printing, used in the sending of correspondence or parcels. The present invention unites in a single paper or synthetic sheet the following properties:

1. That the said sheet is printable by non-impact, thermal transfer printers so that the franking value or other logotypes may be printed on it.
2. That at the same time it is phosphorescent so that it may be obliterated automatically.

Also, at the same time, this processed, paper or synthetic sheet may be printed using any of the traditional printing methods: Offset, Gravure-printing, Flexography, Transfer, etc. to create the non-variable motifs on the adhesive stamp.

DESCRIPTION OF THE OBTENTION PROCEDURE AND OF THE PRODUCT SO OBTAINED

The coat to be applied on the sheet consists of some lactone or spiropyrane type colorings or iron metallic complexes that react with weak organic acids to produce the coloring when heated via a thermal head, as well as activators to accelerate the said reaction. Also absorbent materials and charges to absorb the resulting fusion products. Moreover, it contains an inorganic phosphorescent pigment of the ZnS:Cu type of the appropriate particle size to produce phosphorescence in a pre-specified time and wavelength.

EXAMPLE OF PREPARATION

A practical preparation example of the sheets, object of the invention, is that described below:

The following dispersions are prepared separately:

Dispersion A 10 parts by weight of a coloring derived from spiropyrane (e.g.: 3-diethylamino, 6-methyl, 7-anilino flourane) are dispersed over 100 parts by weight of a base containing 10% polyvinyl alcohol dissolved in water. After a good dispersion, it is processed in a colloidal mill until an average particle size of 1 micron is reached.

Dispersion B 25 parts by weight of Bisphenol-A and 30 parts by weight of Parabenzylbiphenile are dispersed over 100 parts by weight of a base containing 10% polyvinyl alcohol dissolved in water.

After a good dispersion, it is processed in a colloidal mill until an average particle size of 2.5 microns is reached.

Dispersion C 30 parts by weight of calcium carbonate precipitate are dispersed over 100 parts by weight of water. After a good dispersion, it is processed in a colloidal mill until an average particle size of 3 microns is reached.

Dispersion D 20 to 80 parts by weight of SZn:Cu phosphorescent pigment are dispersed over 100 parts by weight of water. Once these dispersions have been performed, they are mixed together to obtain the preparation to apply on the cellulose or synthetic supports (that is, the sheets), by preparing:

80 parts by weight of dispersion A.

155 parts by weight of dispersion B.

185 parts by weight of dispersion C.

100 parts by weight of dispersion D.

The viscosity and solids in the preparation are adjusted to obtain the correct application characteristics according to the machinery used with the object of obtaining a deposition of about 10 gr/m$^2$ in a dry state.

The deposited coat has the properties of:

1. Being able to be printed using thermal transfer printing heads.
2. Producing phosphorescence when activated by ultraviolet light.

The sheets so obtained are therefore, base sheets that may be of a fibrous paper or synthetic composition, with or without security devices, covered with the special coating earlier described, that gives them the property of being able to be printed using thermal transfer printing heads and producing phosphorescence when activated by ultraviolet light containing wavelengths of between 440 and 640 nanometers.

What is claimed is:

1. A process for preparing non-impact, thermal transfer printing sheets comprising the step of:

applying a coating composition to sheets of a fibrous paper or synthetic paper, wherein said coating composition comprises (1) lactone, a spiropyrane coloration, or an iron metallic complex that reacts with a weak organic acid to produce coloration when said sheets are heated via a thermal head, (2) an activator to accelerate the reaction, (3) absorbent materials to absorb the resulting products of said reaction, and (4) an inorganic phosphorescent ZnS:Cu pigment having a particle size sufficient to produce phosphorescence in a predetermined time and wave-length.

2. A non-impact, thermal transfer printing sheet comprising a fibrous paper or synthetic paper, with or without a security device, coated with a composition comprising (1) lactone, a spiropyrane coloration, or an iron metallic complex that reacts with a weak organic acid to produce coloration when said sheet are heated via a thermal head, (2) an activator to accelerate the reaction, (3) absorbent materials to absorb the resulting products of said reaction, and (4) an inorganic phosphorescent ZnS:Cu pigment having a particle size sufficient to produce phosphorescence in a predetermined time and wave-length, wherein said sheet is capable of being printed using a thermal transfer printing head and providing phosphorescence when activated by ultraviolet light containing wavelengths of between 440 and 640 nm.

* * * * *